United States Patent [19]

Rothwell, Jr. et al.

[11] Patent Number: 4,557,700

[45] Date of Patent: Dec. 10, 1985

[54] METAL HALIDE DISCHARGE LAMP GAS FILL PROCESS TO PROVIDE MINIMAL COLOR SEPARATION

[75] Inventors: Harold L. Rothwell, Jr., Rowley; George J. English, Reading, both of Mass.

[73] Assignee: GTE Products Corporation, Stamford, Conn.

[21] Appl. No.: 502,776

[22] Filed: Jun. 9, 1983

[51] Int. Cl.[4] ..... H01J 9/395; H01J 61/20

[52] U.S. Cl. ..... 445/53; 445/26

[58] Field of Search ..... 445/53, 26; 313/640, 313/639, 642, 638, 641

[56] References Cited

U.S. PATENT DOCUMENTS

| | | | |
|---|---|---|---|
| 4,134,039 | 1/1979 | Vida et al. | 313/640 |
| 4,171,498 | 10/1979 | Fromm et al. | 313/116 X |
| 4,360,758 | 11/1982 | Thornton, Jr. et al. | 313/642 X |
| 4,387,319 | 6/1983 | White et al. | 313/634 X |

FOREIGN PATENT DOCUMENTS

| | | | |
|---|---|---|---|
| 48009 | 9/1980 | European Pat. Off. | 313/639 |

*Primary Examiner*—Kenneth J. Ramsey

*Attorney, Agent, or Firm*—Lawrence R. Fraley

[57] ABSTRACT

A single-ended metal halide discharge lamp includes a plurality of fill gases selected to provide essentially white light at a plurality of distances from a pair of spaced electrodes and to combine the radiation from the multiple distances to provide white light with minimal color separation from the discharge lamp. Also, a method for providing spectral uniformity from a discharge lamp is provided wherein the emitted color and distance from a longitudinal axis provided by a plurality of fill gases is observed, fill gases are selected to provide white light emission at a plurality of distances from the longitudinal axis and the selected fill gases are combined to provide white light with minimal color separation from the discharge lamp.

7 Claims, 4 Drawing Figures

METAL HALIDE DISCHARGE LAMP GAS FILL PROCESS TO PROVIDE MINIMAL COLOR SEPARATION

CROSS REFERENCE TO OTHER APPLICATIONS

The following concurrently filed applications relate to single-ended metal halide discharge lamps and the fabrication thereof: bearing U.S. Ser. Nos. 502,773; 502,775; 502,774; and 502,772.

TECHNICAL FIELD

This invention relates to single-ended metal halide discharge lamps and the manufacture thereof and more particularly to a metal halide lamp and method of fabrication thereof to provide light having minimal color separation.

BACKGROUND ART

The tungsten lamp is and has been the most common source of light for applications requiring a relatively intense light source such as projectors, optical lens systems and similar applications. Unfortunately, such structures are configured in a manner which tends to develop undesired heat and, in turn, necessitates expensive and cumbersome cooling devices located immediately adjacent the light source in order to provide the required cooling. Also, such structures tend to have an inherent problem in that the life of the light source is relatively short, about 10 and 20 hours of operational life, for example. Thus, it is a common practice to replace the light source of the structures each time the system is to be employed. Obviously, the inconvenience and expense of light source replacement each time the apparatus is used leaves much to be desired.

An improvement over the above-described tungsten lamp system is provided by a system utilizing a high intensity discharge lamp as a light source. For example, a common form of HID lamp is the high pressure metal halide discharge lamp as disclosed in U.S. Pat. No. 4,161,672. Therein is disclosed a double-ended arc tube configuration or an arc tube having electrodes sealed into diametrically opposite ends with an evacuated or gas-filled outer envelope. However, the manufacture of such double-ended structures is relatively expensive and the configuration is obviously not appropriate for use in projectors and similar optic-lens types of apparatus.

An even greater improvement in the provision of a light source for projectors and optic-lens apparatus is set forth in the single-ended metal halide discharge lamps as set forth in U.S. Pat. Nos. 4,302,699; 4,308,483; 4,320,322; 4,321,501 and 4,321,504. All of the above-mentioned patents disclose structure and/or fill variations which are suitable to particular applications. However, any one or all of the above-mentioned embodiments leave something to be desired insofar as arc stability and minimal color separation capabilities are concerned.

OBJECTS AND SUMMARY OF THE INVENTION

An object of the present invention is to provide an improved single-ended metal halide lamp. Another object of the invention is to provide a light source having a minimal color separation. Still another object of the invention is to provide a light source in the form of a metal halide discharge lamp structure having a minimal separation of colors for use in a projection system. A further object of the invention is to provide a process for fabricating a metal halide lamp with spectral uniformity.

These and other objects, advantages and capabilities are achieved in one aspect of the invention by a metal halide discharge lamp having an elliptical-shaped envelope with a pair of electrodes passing through one end thereof and a plurality of additive gases having characteristic emission spectra of different wavelengths or frequencies at differing spacial distribution within the discharge lamp wherby different additive gases are combined to provide a net white light emission from different regions in the discharge lamp.

In another aspect of the invention, spectral uniformity of emitted light from a metal halide discharge lamp is effected by a process comprising the steps of selecting a plurality of additive gases each emitting a different spectra of colors at differing spacial distributions from a core intermediate a pair of electrodes of a discharge lamp, combining selected additive gases to provide substantially white light emission at differing spacial distributions from the core and integrating the white light emission from differing spacial distributions to provide a white light source from a discharge lamp.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
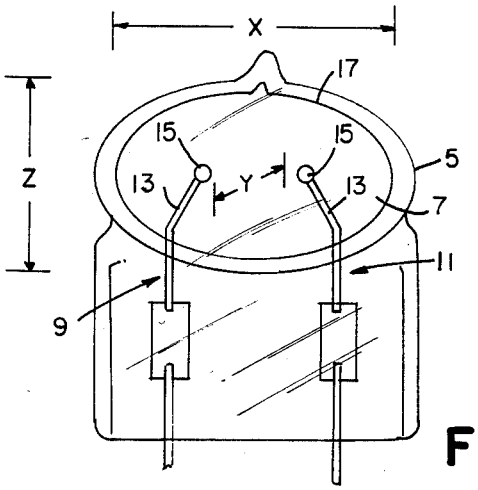
FIG. 1 is a cross-sectional view of one embodiment of a single-ended metal halide lamp of the invention.

Referring to FIG. 1 of the drawings, FIG. 1 illustrates a low wattage metal halide lamp having a body portion 5 of a material such as fused silica. This fused silica body portion 5 is formed to provide an elliptical-shaped interior portion 7 having major and minor diametrical measurements, "X" and "Y" respectively, in a ratio of about 2:1. Moreover, the elliptical-shaped interior portion 7 of the body portion 5 preferably has a height "Z" substantially equal to the minor dimensional measurement "Y".

Sealed into one end of and passing through the body portion 5 is a pair of electrodes 9 and 11. Each of the electrodes 9 and 11 includes a metal rod 13 with a spherical ball 15 on the end thereof within the elliptical-shaped interior portion 7. Preferably, the electrodes 9 and 11 are positioned within the elliptical-shaped interior portion 7 in a manner such that the spherical balls 15 of the electrodes 9 and 11 are substantially equally spaced from the interior portion 7 insofar as the major and minor axes, "X" and "Y", and also substantially at the midpoint of the height dimension "Z". Moreover, the spherical balls 15 are spaced from one another along a longitudinal axis extending in the direction of the major axis "X".

Spherical balls 15 are spaced from one another along a longitudinal axis extending in the direction of the indicated major axis "X" of the body portion 5. A plurality of gases is disposed within the interior portion 7 and, it has been observed, the gases tend to emit in one or more regions or at one or more frequencies of the visible spectrum with a spacial distribution from the longitudinal axis intermediate the spherical balls 15 peculiar to each of the gases.

Figure 2:
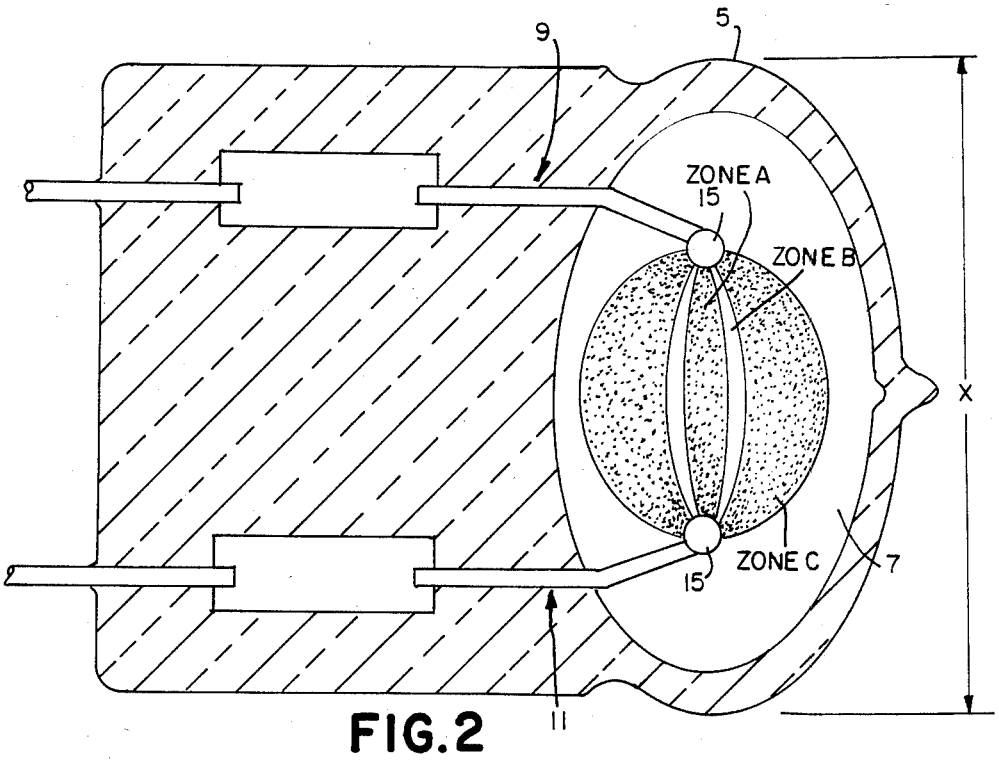
FIG. 2 is a diagrammatic sketch illustrating emission zones for various gases in the discharge lamp of FIG. 1.
Figure 4:
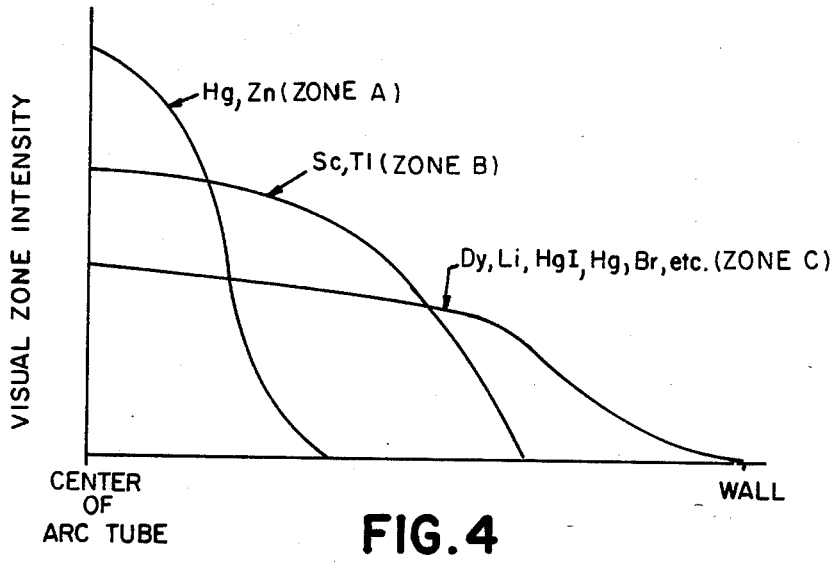
FIG. 4 is a chart comparing the intensity of emission of various gases at varying distances from longitudinal axis of the electrodes of the metal halide lamp of FIG. 1.

For example, it has been observed that additive gases such as mercury and zinc tend to emit primarily in the core of first emission zone, "A" of FIGS. 2 and 4, which in this example has a radius of about 0.5 mm. Also, trace elements such as thorium and silicon are found to emit in the above-mentioned first or core emission zone "A". Surrounding and enveloping the first emission zone "A" is a second emission zone, zone "B", which has a radius of about 1.0 mm and whose emission is dominated by additive gases of scandium and thallium. Also, a third emission zone, zone "C", has a radius of about 1.5 mm enveloping the first and second zones "A" and "B" and extending beyond the second emission zone "B" to the interior portion 7 of the body portion 5 of the discharge lamp. This third emission zone, zone "C", exhibits radiation from additive gases such as metal iodides and bromides as well as resonance radiation from materials such as sodium and dysprosium.

Figure 3:
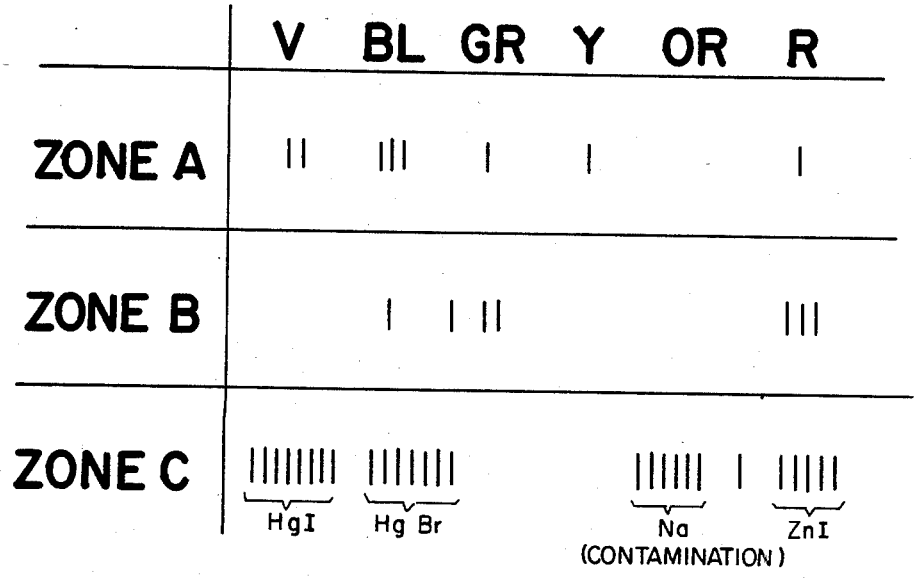
FIG. 3 is a table setting forth the color distribution of the various emission zones of FIG. 2.

Also, it is to be noted that by particular selection of the additive gases which emit within particular zones it is possible to provide substantially "white" light emission from each one of the zones, "A", "B" and "C". For example, the table of FIG. 3 illustrates that the mercury and zinc of zone "A" provide a wide range of emitted radiation, i.e., violet, blue, green, yellow and red. Similarly, the scandium and thallium of zone "B" tend to provide blue, green and red while zone "C" is dominated by violet from mercury iodide, blue-green from mercury bromide, orange from sodium contamination and red from lithium. Thus, proper selection of additive elements permits the development of a substantially "white" light from each one of the zones or at differing distances from the longitudinal axis intermediate the spherical balls 15 of the metal halide discharge device.

Additionally, the chart of FIG. 4 approximates the spread and intensity of radiation of the various selected elements for each of the zones within the discharge lamp. In other words, intensity and spread of radiation is compared at the locations starting at the longitudinal axis of the spherical balls 15 or the center of the first zone, zone "A", and progressing to the third zone, zone "C", which approaches the interior portion, 7 of FIG. 1, of the discharge lamp. As can readily be seen, by proper choice of the selected elements it is possible to provide radiation over a wide band of the spectrum in each one of the zones. Moreover, by combining these selected elements, the wide band of radiation or "white light" of each of the zones of radiation can be combined to provide "white light" from the discharge tube which has good spectral uniformity and a minimal color separation.

Obviously, a minimal color separation is important in a discharge lamp employed in a projector or optic-lens system. Moreover, it has been found that such minimal color separation is achievable by minimizing color differences in each of the zones and combining the radiation of minimal color differences from each of the radiation zones to provide light output from the discharge lamp.

Additionally, it is to be noted that an arc source, such as a metal halide discharge lamp, provides not only higher luminance but also higher efficacy than a tungsten source. Also, a metal halide discharge lamp provides a point source relative to a tungsten source. Specifically, a 100-watt metal halide discharge lamp exhibits a plasma having a minimum luminance intermediate the spherical balls 15 and a maximum luminance at or near the spherical balls 15. Moreover, the plasma column is normally about 1 to 2 mm in diameter and about 3 mm in length. However, a tungsten source is about 2.5 mm in diameter and 8 mm in length with the luminance varying in a sinusoidal manner over the length of the tungsten source.

Following is a table, Table I, showing a comparison in luminance, efficacy and size of a tungsten source, a high pressure xenon source and a metal halide lamp source:

TABLE I

| | Luminance (Cd/mm) | Efficacy (Lumens/Watt) | Size (Length × Diam.) | Theoretical Throughput (Lumens) |
|---|---|---|---|---|
| Tungsten (300 Watts) | 30 | 33 | 8 × 2.5 | 1980 |
| Xenon (150 Watts) | 150 | 20 | 2.2 × 5 | 600 |
| Metal Halide Lamp (100 Watts) | 75 | 65 | 3 × 1 | 1300 |

As can readily be seen, the tungsten source at 300 watts provides about 33 lumens per watt as compared with 65 L/W for a 100-watt metal halide lamp. Also, tests in a 35 mm projection system indicate an output of about 10,000 lumens from the 300-watt tungsten source is equivalent to that of the 6,500 lumens from the 100-watt metal halide lamp source. The long wavelength radiation and the misdirected visible light of the tungsten source tends to be absorbed as heat by the film of a projector. Thus, is has been found that the tungsten lamp generates about 270 watts of heat as compared to about 90 watts or about ⅓ thereof by the metal halide lamp and associated power supply.

Further, the xenon source shows a relatively high luminance capability but a relatively low efficacy capability. Thus, a lumen output of the xenon source which is comparable to that provided by a 100-watt metal halide lamp would necessitate a xenon source of about 200 watts in order to compensate for a relatively poor efficacy capability. Moreover, a xenon source has a relatively small diameter, about 0.5 mm in the example, as compared with a metal halide lamp, about 1.0 mm, which greatly and undesirably reduces the tolerances or variations in positioned location of the arc source when employed with a reflector in a projection system. In other words, positional adjustment of an arc source in a xenon lamp is much more critical than in a metal halide discharge lamp system.

As a specific, but in no way limiting, example of a proper fill for a single-ended metal halide discharge lamp, the following proportions were found appropriate:

| | |
|---|---|
| mercury | 6.00 mg |
| lithium iodide | 0.10 mg |
| zinc | 0.10 mg |

-continued

| | |
|---|---|
| scandium iodide | 0.30 mg |
| thallium iodide | 0.05 mg |
| dysprosium iodide | 0.05 mg. |
| mercury iodide | 0.60 mg |
| mercury bromide | 0.10 mg |
| argon | 400.00 Torr |

Thus, a single-ended metal halide discharge lamp and a process for fabricating such lamps is provided. Accordingly, a spectral balanced light output derived from a multiplicity of color balanced zones of varying positional location within the discharge lamp is provided. As a result, an enhanced metal halide light source with minimal color separation, reduced cost, and reduced power loss due to heat is provided.

While there has been shown and described what is at present considered the preferred embodiments of the invention, it will be obvious to those skilled in the art that various changes and modifications may be made therein without departing from the invention as defined by the appended claims.

What is claimed is:

1. A process for effecting spectral uniformity of emitted light from a single-ended metal halide discharge lamp having a pair of electrodes with a spherical ball on the end of each one and spaced from one another along a longitudinal axis and sealed within an elliptical-shaped fused silica envelope having an inner wall comprising the steps of:

selecting a plurality of fill gases and additive gases each having different spectra of colors at differing spacial distributions of said discharge lamp;

selecting a plurality of overlapping zones extending outwardly from said core intermediate said pair of electrodes and choosing additive gases in a manner to provide emission of substantially white light from each of said plurality of overlapping zones; and combining said selected additive gases in a manner to provide substantially white light emission at differing spacial distances from said core of said discharge lamp and integrating said white light emission at different spacial distances to provide emitted white light having minimal color separation from said discharge lamp.

2. The process of claim 1 wherein said fill gases include argon and mercury and said additive gases are selected from the group consisting of zinc, lithium, scandium, thallium, dysprosium and mercury bromides and iodides.

3. The process of claim 1 including the step of selecting a first emission zone or core substantially surrounding said longitudinal axis intermediate said pair of electrodes; a second emission zone including and outwardly surrounding said first emission zone, and a third emission zone including said first and second emission zones and outwardly surrounding said second emission zone and choosing additive gases to provide substantially white light emission from each of said overlapping zones whereby color separation of light from said discharge lamp is minimal.

4. The process of claim 3 wherein the additive gases chosen which emit primarily within said first emission or core zone are gases of mercury and zinc.

5. The process of claim 3 wherein the additive gases chosen which emit primarily within said first and second emission zones are gases of scandium and thallium.

6. The process of claim 3 wherein the additive gases chosen which emit primarily within said first, second and third emission zones are gases of mercury bromide, mercury iodide, zinc iodide, lithium and dysprosium.

7. The process of claim 1 wherein said first emission zone or core is selected to have a radius of about 0.5 mm, said second emission zone has a radius of about 1.0 mm and said third emission zone has a radius of about 1.5 mm.

* * * * *

UNITED STATES PATENT AND TRADEMARK OFFICE

CERTIFICATE OF CORRECTION

PATENT NO. : 4,557,700

DATED : December 10, 1985

INVENTOR(S) : HAROLD L. ROTHWELL, JR.; GEORGE J. ENGLISH

It is certified that error appears in the above—identified patent and that said Letters Patent is hereby corrected as shown below:

On the front page, an asterisk (*) should precede "Dec. 10, 1985" in item [45]; the following notice should appear between items [75] and [73]:

[*] Notice: The portion of the term of this patent subsequent to July 9, 2002 has been disclaimed.

Signed and Sealed this

*First* Day of *April 1986*

[SEAL]

*Attest:*

DONALD J. QUIGG

*Attesting Officer*

*Commissioner of Patents and Trademarks*